United States Patent [19]

Babasov et al.

[11] 4,090,381

[45] May 23, 1978

[54] DEVICE FOR DRAWING-OFF AND STRAIGHTENING CYLINDRICALLY SHAPED STOCK

[76] Inventors: Mikhail Vladimirovich Babasov, ulitsa Tsentralnaya, 10, kv. 14; Viktor Afanasievich Zazimko, ulitsa Parizhskoi Kommuny, 20; Iraida Ivanovna Reidemeister, ulitsa Universitetskaya, 10, kv. 55; Jury Lukich Semenenko, ulitsa Gogolya, 1, kv. 30, all of Dnepropetrovsk; Zelik Ilich Pertsikov, ulitsa Dzerzhinskogo, 29, kv. 74, Irkutsk; Mikhail Samuilovich Levin, ulitsa Dzerzhinkskogo, 29, kv. 103, Irkutsk; Valery Konstantinovich Eremeev, ulitsa Marata, 15/2, kv. 56, Irkutsk; Leonid Mikhailovich Varava, ulitsa Gagarina, 161, kv. 23, Dnepropetrovsk, all of U.S.S.R.

[21] Appl. No.: 755,609

[22] Filed: Dec. 29, 1976

Related U.S. Application Data

[63] Continuation of Ser. No. 589,514, Jun. 23, 1975, abandoned.

[51] Int. Cl.[2] ..... B21C 3/14

[52] U.S. Cl. ..... 72/68; 72/79; 72/285

[58] Field of Search ..... 72/68, 77, 78, 79, 274, 72/278, 281, 285; 140/147; 226/198

[56] References Cited

U.S. PATENT DOCUMENTS

| | | | |
|---|---|---|---|
| 1,735,871 | 11/1929 | Olson | 72/77 |
| 2,226,400 | 12/1940 | Gaines | 140/147 |
| 2,487,141 | 11/1949 | Kehl | 72/79 |

FOREIGN PATENT DOCUMENTS

| | | | |
|---|---|---|---|
| 125,274 | 4/1928 | Switzerland | 72/277 |

*Primary Examiner*—Lowell A. Larson
*Attorney, Agent, or Firm*—Haseltine, Lake & Waters

[57] ABSTRACT

A device mounted on a drawbench stand, comprising a case with at least one drawing die or draw head, and stock guides arranged along the drawing-off axis on both sides of the die. Mounted intermediate of the stock guides is a stock straightening gear, including a housing accommodating at least one drive rotor whose axis coincides with the drawing-off axis. The rotor carries the case with the die set up eccentrically in bearings and non-rotatably about its axis. As the rotor rotates during the drawing-off operation, the drawing die transmits alternating bending forces to the stock, the guides acting as supports while the stock is bent.

3 Claims, 4 Drawing Figures

DEVICE FOR DRAWING-OFF AND STRAIGHTENING CYLINDRICALLY SHAPED STOCK

CROSS RELATED APPLICATION

This application is a continuation of co-pending application Ser. No. 589,514 filed June 23, 1975, now abandoned.

The present invention relates to the production of cylindrically shaped metal articles (tubes, bars) by drawing and more particularly to a device for drawing and straightening cylindrically shaped metal stock.

Usually metal articles (tubes, bars) manufactured by drawing off are distorted. Their distortion is due to by a number of factors, such as: inadequately precise alignment of the drawhole or drawing-die axis and the direction of a pulling force, irregular shape of the die, inadequately uniformity of the properties of material being drawn, etc. The distortion of the stock causes difficulties during the further processing.

At present the solution to this urgent problem, i.e. the prevention of the distortion of the stock (tubes, bars) during the drawing-off operation, has not yet been found.

The distortion of such stock during drawing-off is partly reduced by making use of spherical supports in which the drawing dies are mounted.

Thus, U.S. Pat. No. 3131803 protects a device for the cold drawing off of tubes. In this device a drawing with an external surface machined as a part of a sphere is inserted in a support whose internal surface is machined to agree with the external surface of the drawing die. Owing to the use of spherical connections between the die and its support, the die is self-oriented during the drawing-off operation, a feature ensuring accurate alignment of the drawing-die axis and the direction of the pulling force.

However, the distortion of pieces produced by pulling them through a drawing die mounted in a spherical support is still too great since the used method fails to eliminate the remaining reasons that cause the distortion of such articles.

Also known is a device for drawing off and straightening cylindrically shaped stock, comprising a case with a drawing die fixed on a drawbench stand. Arranged on both sides of the die are guides supporting the stock as it travels along the drawing-off axis. Mounted intermediate of the guides is a gear to straighten the stock by applying alternating bending forces thereto (see German Pat. No. 2249994).

In this prior-art device the die is stationary and the straightening gear arranged on the drawbench, on the exit side of the die, has a ring of a high-strength material mating with the stock being drawn off and fitted to suit an articulated support. The latter is pressed into an eccentric bush resting on a drive bush, concentric with the drawing-off axis. When the drive bush is operated, the midpoint of the ring matting with the stock circulates about the drawing-off axis with a radius corresponding to an adjustable eccentricity of the eccentric bush.

However, since there is no support on the exit side of the device, the articles produced on this device do not posses a sufficient degree of rectilinearity.

With a view of improving the straightening process on the above outlined device, its description contains recommendations on the installation of an additional guide bush that is to be mounted behind the stock straightening gear, if viewed from the drawing die. In this case the alternating bending of the stock is accomplished on a section arranged between the die and the additional bush, which act as supports.

One of the disadvantages of this prior-art device resides in its flow sheet envisaging at first the distortion of the stock in the die and then the straightening of the distorted stock by making use of the die as a support. The realization of this flow sheet calls for considerable straightening forces, increasing sharply with the increase in diameter and strength characteristics of the stock material, which necessitates a reinforcement of the device, and the application of a drive featuring a higher rating. In this case the accuracy of straightening still is not so good.

To attain a straightening effect the additional bush in this known device must be spaced at a sufficient distance from the stock straightening gear. The above spacing depends on a number of factors including stock diameter and material. In this case the length of a thinned end of the stock, that is to be caught, may reach a considerable value, exceeding the distance between the guide, set up in front of the die at its entrance, and the additional guide bush arranged behind the stock straightening gear, since the thinned end of the stock must pass through the guide bush, stock straightening gear and additional guide bush, to be caught by the draw tongs. An increase in the length of the thinned stock end causes a higher inefficient consumption of metal.

The prior-art device under consideration suffers from one more disadvantage, i.e. the rotation of the straightening gear about the stock, during which it may damage the external surface of the stock by making transverse soratches and galling.

To ensure the supply of sufficiently rectilinear drawpieces for subsequent processing or final straightening, the up-to-date technological processes envisage a special intermediate straightening operation. Such intermediate straightening operations require considerable labour input, additional straightening machinery and production floor area for their allocation, which diminishes the efficiency of the technological process as a whole and ultimately causes an increase in the prime cost of the finished products.

The main object of the invention is the provision of a device for drawing off and straightening cylindrically shaped stock which produces them with a sufficient rectilinearity, excluding intermediate straightening operations and ensuring the production of satisfactory finished articles when the drawing off is the final operation.

These and other objects are achieved by the provision of a device for drawing off and straightening cylindrically shaped stock, comprising a case with at least one drawing die mounted on a drawbench stand with stock guides arranged on both sides of the die along the drawing-off axis, and a gear mounted intermediate of the guides for straightening the stock by applying alternating bending forces thereto.

According to the invention, the stock straightening gear includes at least one housing accommodating a drive rotor whose axis of rotation coincides with the drawing-off axis, the rotor enclosing the case with the drawing die, mounted eccentrically in bearings and non-rotatably about its axis, through which rotor is rotating during the drawing-off, the die transmits alternating bending forces to the stock, when the rotor rotates during the drawing operation, with the guides acting as supports, as the stock being drawn is bent.

Thus when the rotor rotates in the course of drawing off, the drawing die that does not rotate about its own axis but rotates about the drawing axis, acting on the stock being drawn and subjecting it to repeated alternating bendings on the section enclosed between the supports which precludes the distortion of the stock being drawn off.

It is recommended that the guide disposed on the exit side of the drawing die acting as a support when the stock being drawn is bent be arranged on a slider travelling along the drawing axis, which allows estimating the requisite spacing between the supports that is needed to create a bending moment sufficient for the adequate straightening of the stock and for catching the thinned stock end of a standard-length stock with draw carriage tongs. As a result, the movable support creates the necessary conditions for the straightening of the stock and makes it possible to avoid inefficient consumption of metal.

It is also advisable that in a device with several parallel drawing dies and rotors the dies be displaced with respect to their respective rotors so that the die axes are displaced in different radial directions relative to the rotor axes, which precludes rotor run-out and ensuing vibration of the drawbench.

The present invention results in the provision of a device for drawing off and straightening cylindrically shaped stock that renders possible the producing of articles with a high degree of rectilinearity. This rules out the need for straightening such articles after the drawing, which enhances substantially the operating efficiency and decreases the production cost, particularly of rectilinear tubes and bars, owing to the elimination of the straightening operations and, of the expenditures for corresponding facilities.

The nature of the invention will be clear from the following detailed description of particular exemplary embodiments to be had in conjunction with the accompanying drawings, in which.

Figure 1:
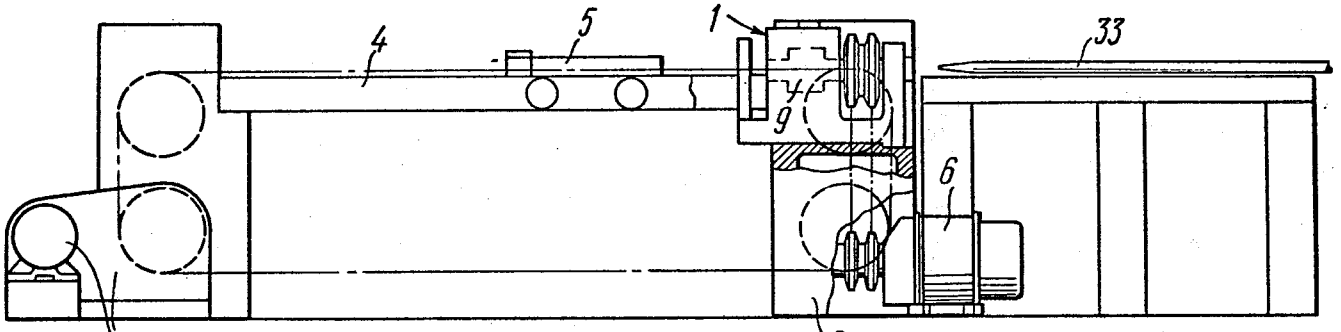
FIG. 1 is a general side view of a drawbench with a device for drawing off and straightening cylindrically shaped stock, according to the invention, (a side view)
Figure 2:
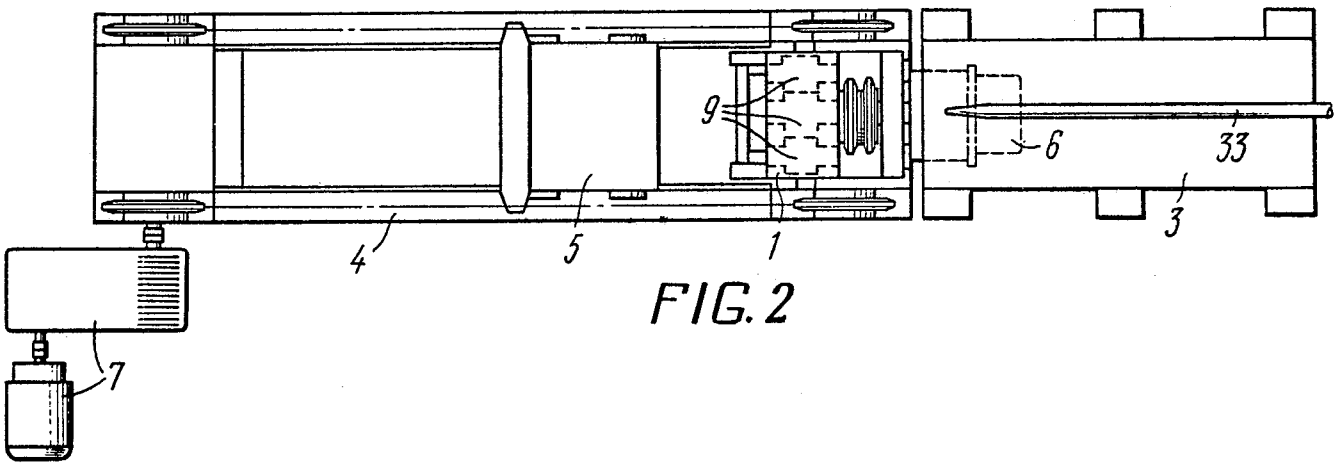
FIG. 2 is a top view.

Referring to FIGS. 1 and 2, a drawbench comprises a device 1 for drawing off and straightening cylindrically shaped stock, set up on a stand 2 between a loading table 3 and a frame 4 for guides of a draw carriage 5 and fitted with an individual drive 6 not coupled with a gear 7 for transferring the draw carriage 5. Stock being processed is shown in FIG. 3 at 33.

Figure 3:
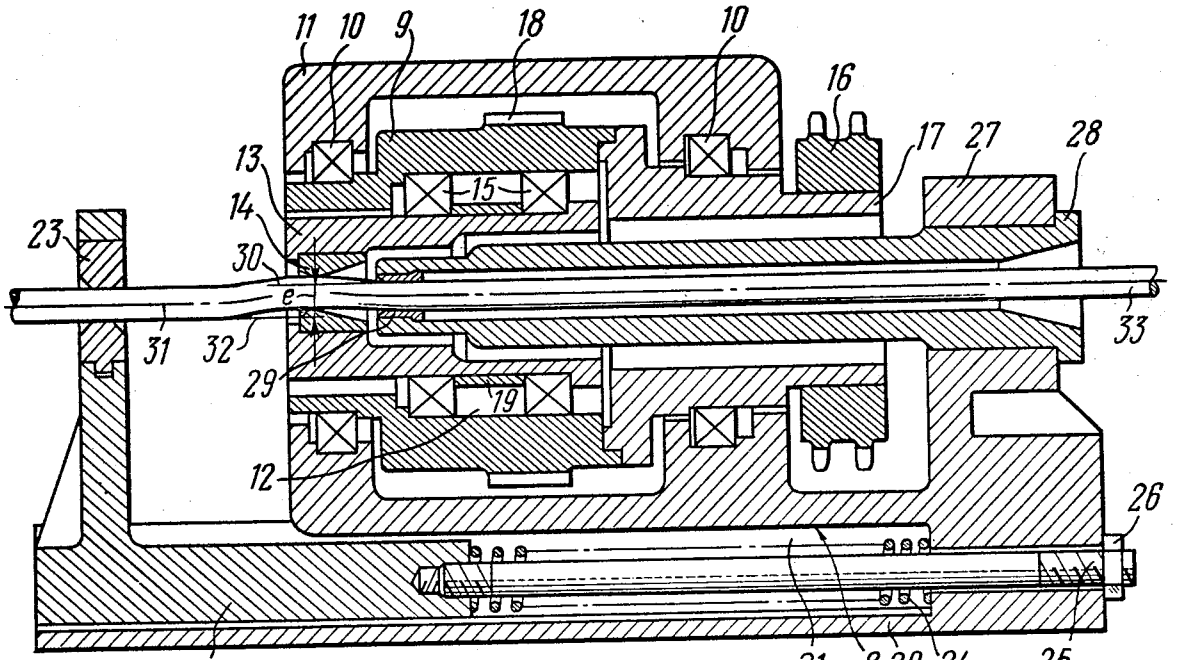
FIG. 3 is a longitudinal sectional view of inventive device; drawing and straightening cylindrically shaped stock, according to the invention.
Figure 4:
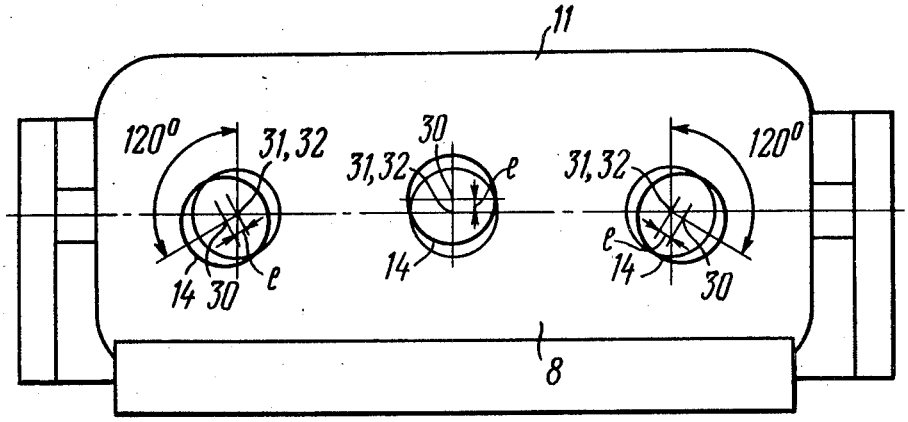
FIG. 4 shows diagrammaticaly the relative arrangement in the device of drawing dies and their rotors for a triple-die drawbench.

The device 1 illustrated in FIGS. 3 and 4 comprises a housing 8 accommodating, as a matter of example, three rotors 9 (FIGS. 1 through 3) in bearings 10. The housing 8 is provided with a cover 11. Mounted eccentrically in a bore 12 of each rotor 9 is a case 13 with a drawing or draw head 14 fixed therein. The case 13 of the die 14 is mounted in bearings 15 fixed on the rotor. It should be understood that the following description, although in the singular, also relates to arrangements having a plurality of rotors 9 and associated drawing dies 14.

When the rotor 9 rotates, the case 13 with the die 14 does not rotate about its axis but performs a rotary motion about the drawing-off axis since the axis of the case 13 is displaced by an eccentricity value "*e*" relative to the coinciding rotor and drawing-off axes (FIG. 3).

The rotors are brought in rotation by the drive 6 (FIGS. 1, 2) through a chain (not shown in the drawing) and a drive sprocket 16 rigidly fixed on a tail 17 of one of the rotors 9. The rotors 9 are interconnected through gears 18. There may be mounted distance sleeves 19 intermediate the bearings 15. In the bottom part of the housing 8 provision is made for guides 20 and slots 21 in which is set up a slider 22 of an exit guide 23 made as a bush. A spring 24 adapted to mount the guide 23 at a preset distance in front of the die 14 is set up on a rod 25. The distance between the exit guide 23 and the drawing die 14 is adjusted by means of a nut 26 of the rod 25.

A rear support 28 with a replaceable guide (bush) 29 is mounted on a stand 27 of the housing 8. Since the case 13 is disposed eccentrically, the axis 30 of the die 14 is displaced by an eccentricity value "*e*" relative to axes 31 and 32 of the guides 23 and 29, these axes coinciding also with the drawing axis (FIG. 3).

In case of double-die or more drawing parallel dies 14, they are so arranged with respect to their rotors 9 that their axes are constantly displaced from these of rotors in different radial directions (FIG. 4). Thus, with a triple-die drawbench the dies are displaced relative one to the other at an angle of 120°. The above arrangement of the dies 14 relative to their rotors 9 precludes their run-out and a vibration of the drawbench.

Considered hereinbelow is the operation of one of the rotors with its drawing die, as the rotors being all similar in their design and principle of operation.

The front movable guide 23 and the rear guide 29 are installed at a requisite distance from the die 14. The drive 6 of the rotors 9 is actuated. The stock 33 is fed into the die, e.g. by means of a driving gear (not shown in the drawing). The draw carriage 5 is reversed and pushes the slider 22 of the exit guide 23 until it comes in contact with the end face of the case 13 of the die 14.

The use of the movable guide 23 makes it possible to catch the thinned end of the stock 33 by the draw tongs of the carriage 5 practically without increasing the stock length. As soon as the stock end is caught, the draw carriage 5 performs its working stroke, i.e. the drawing-off operation is effected. Under the effect of the spring 24 and frictional forces brought about when the tube moves in the guide 23, the slider 22 occupies its initial position that is necessary to attain a straightening effect.

An eccentric arrangement of the axis 30 of the drawing die 14 with respect to the axes 31 and 32 of the guides 23 and 29 accordingly gives rise to a concentrated load acting on the stock 33, being drawn on the side of the die 14, with the ensuing creation of the bending moment acting on the stock 33 on the section enclosed between the guides 23 and 29.

In this case the guides 23 and 29 are employed as supports while the stock being drawn is bent.

An eccentric arrangement of the die 14 in the respective rotating rotor 9 ensures a continuous alteration of the direction of action of the bending force, owing to which the sign of the bending moment is also changed and the stock is exposed to a repeated alternating bend as it is pulled through the die, with the direction of action of the bending forces being changed alternately.

Since the rotor 9 rotates, the die 14 performs a rotary motion about the axes 31 and 32 with an eccentricity equal to "*e*" and at rpm determined by the speed of the drive 6.

Thus any distortion of the stock is precluded since it is exposed to repeated alternating bending directly in the deformation area.

The drawing die rpm is adjusted by changing that of its rotor drive, and its bending moment value by changing the eccentricity "*e*".

We claim:

1. A device for drawing and straightening cylindrically shaped stock, mounted on a drawbench stand and comprising: a die case; a die fixed in said case; stock guides arranged along a drawing axis on both sides of said die; means for straightening the stock by applying alternating bending forces thereto; said stock straightening means, comprising: a housing, a drive rotor having an axis of rotation which coincides with the drawing axis, accommodated in said housing and incorporating said case with the die, bearings supporting said case and die eccentrically such that said die is non-rotatable about its axis; whereby when said rotor rotates during the drawing operation, said die transmits alternating bending forces to the stock, with said guides acting as supports when the stock being drawn is bent, a slider having an adjustable stroke adapted to reciprocate along an axis parallel to the drawing-off axis, one of said guides being disposed on the exit side of said drawing die and being fixed to said slider.

2. A device as claimed in claim 1 comprising a resilient member acting on the slider.

3. A device as claimed in claim 1 comprising means adjustably and resiliently supporting said slider for reciprocal movement along said drawing-off axis comprising a stem slidably mounted in said housing for movement parallel to the drawing-off axis, means adjustably connecting said stem to said slider, spring means between said housing and said slider, and a nut threaded on said stem and serving as a stop engaging said housing for varying the travel stroke of the slider.

* * * * *